US011004380B2

(12) United States Patent
Dai

(10) Patent No.: US 11,004,380 B2
(45) Date of Patent: May 11, 2021

(54) GATE DRIVER ON ARRAY CIRCUIT

(71) Applicant: Wuhan China Star Optoelectronics Technology Co., Ltd., Wuhan (CN)

(72) Inventor: Ronglei Dai, Wuhan (CN)

(73) Assignee: WUHAN CHINA STAR OPTOELECTRONICS TECHNOLOGY CO., LTD., Hubei (CN)

( * ) Notice: Subject to any disclaimer, the term of this patent is extended or adjusted under 35 U.S.C. 154(b) by 310 days.

(21) Appl. No.: 16/319,822

(22) PCT Filed: Sep. 22, 2018

(86) PCT No.: PCT/CN2018/107143
§ 371 (c)(1),
(2) Date: Jan. 23, 2019

(87) PCT Pub. No.: WO2019/227791
PCT Pub. Date: Dec. 5, 2019

(65) Prior Publication Data

US 2021/0082334 A1 Mar. 18, 2021

(30) Foreign Application Priority Data

May 28, 2018 (CN) ..... 201810525852.0

(51) Int. Cl.
*G09G 3/20* (2006.01)

(52) U.S. Cl.
CPC ... *G09G 3/2092* (2013.01); *G09G 2310/0267* (2013.01); *G09G 2320/0257* (2013.01)

(58) Field of Classification Search
CPC ..... G09G 3/2092; G09G 2310/0267; G09G 2320/0257
USPC ..... 345/204
See application file for complete search history.

(56) References Cited

U.S. PATENT DOCUMENTS

2009/0167668 A1* 7/2009 Kim ..... G11C 19/28 345/100
2017/0102805 A1* 4/2017 Xiao ..... G06F 3/04184

FOREIGN PATENT DOCUMENTS

CN 101383133 A 3/2009
CN 104090436 A 10/2014
CN 105427787 A 3/2016
CN 106019735 A 10/2016
CN 106206619 A 12/2016
CN 107329341 A 11/2017
(Continued)

*Primary Examiner* — Mark Edwards
(74) *Attorney, Agent, or Firm* — Leong C. Lei

(57) ABSTRACT

The present invention teaches a Gate Driver on Array (GOA) circuit for a display panel. The GOA circuit includes a first dummy GOA unit and/or a second dummy GOA unit not connecting scan lines of the display panel's active area, and normal GOA units connecting scan lines of the active area. The normal GOA units are cascaded into a chain. The first dummy GOA unit is cascaded to a first normal GOA unit of the chain and/or the second dummy GOA unit is cascaded to a last normal GOA unit of the chain. A start signal of the display panel's vertical scanning as a cascaded signal is input into the first dummy GOA unit and/or the second dummy GOA unit. The GOA circuit excludes the line of afterimage from the active area, thereby allowing the fast black frame insertion after abnormal shutdown.

8 Claims, 3 Drawing Sheets

(56) References Cited

FOREIGN PATENT DOCUMENTS

| | | | |
|---|---|---|---|
| CN | 108010495 | A | 5/2018 |
| JP | 2010020282 | A | 1/2010 |

* cited by examiner

GATE DRIVER ON ARRAY CIRCUIT

FIELD OF THE INVENTION

The present invention is generally related to the field of display technology, and more particularly to Gate Driver On Array (GOA) circuit.

BACKGROUND OF THE INVENTION

Gate Driver On Array (GOA) technique is to integrate gate driving circuit on a display panel's array substrate so as to achieve line-by-line gate line scanning. Using GOA circuit may significantly reduce the number of external ICs, thereby lowering production cost and power consumption. GOA technique may also achieve display devices of narrow bezel.

However, existing GOA technique cannot achieve fast black frame insertion when control IC is abnormally shut down. At this point, all gate lines have to be turned on and a black frame is quickly inserted so as to avoid the after-image.

SUMMARY OF THE INVENTION

Therefore, an objective of the present invention is to teach a GOA circuit capable of achieving fast black frame insertion after abnormal shutdown.

To achieve the objective, the present invention teaches a GOA circuit for a display panel comprising a plurality of cascaded GOA units, wherein the GOA units comprises a first dummy GOA unit and/or a second dummy GOA unit not connecting scan lines of the display panel's active area; the GOA units further comprises a plurality of normal GOA units connecting scan lines of the active area; the normal GOA units are cascaded into a chain of normal GOA units; the first dummy GOA unit is cascaded to a first normal GOA unit of the chain of normal GOA units and/or the second dummy GOA unit is cascaded to a last normal GOA unit of the chain of normal GOA units; a start signal of the display panel's vertical scanning as a cascaded signal is input into the first dummy GOA unit and/or the start signal as a cascaded signal is input into the second dummy GOA unit.

A GOA unit at an nth (n is a natural number) stage of the plurality of cascaded GOA units comprises a pull-up control module, a pull-up module, a pull-down control module, a pull-down module, a general control module, and a reset module; the pull-up control module receives the cascaded signal from a GOA unit at a previous stage and/or at a next stage, and controls the pull-up module to pull up a voltage level at the GOA unit's scanning signal output terminal; the pull-down control module controls the pull-down module to pull down the voltage level at the GOA unit's scanning signal output terminal; the general control module controls the voltage level at the GOA unit's scanning signal output terminal; and the reset module resets the voltage level at the GOA unit's scanning signal output terminal.

The Pull-Up Control Module Comprises a first thin film transistor (TFT) having the gate connected to the scanning signal output terminal of a GOA unit at a (n−2)th stage, the source connected to a forward scanning signal, and the drain connected to a first junction;

a second TFT having the gate connected to the scanning signal output terminal of a GOA unit at a (n+2)th stage, the source connected to a backward scanning signal, and the drain connected to the first junction;

a fifth TFT having the gate connected to a second junction, the source connected to the first junction, and the drain connected to a low-level signal; and a seventh TFT having the gate connected to a high-level signal, the source connected to the first junction, and the drain, as the pull-up control module's output terminal, connected to the pull-up module.

The pull-up module comprises a ninth TFT having the gate connected to an output terminal of the pull-up control module, the source connected to an nth-stage clock signal, and the drain connected to the scanning signal output terminal.

The pull-down control module comprise a third TFT having the gate connected to a forward scanning signal, the source connected to a (n+1)th-stage clock signal, and the drain connected to the gate of an eighth TFT;

a fourth TFT having the gate connected to a backward scanning signal, the source connected to a (n−1)th-stage clock signal, and the drain connected to the gate of the eighth TFT;

a sixth TFT having the gate connected to a first junction, the source connected to a second junction, and the drain connected to a low-level signal;

the eighth TFT having the source connected to the second junction, and the drain connected to a high-level signal; and a twelfth TFT having the gate connected to a general control signal, the source connected to the second junction, and the drain connected to the low-level signal.

The pull-down module comprises a tenth TFT having the gate connected to a second junction, the source connected to the scanning signal output terminal, and the drain connected to a low-level signal.

The general control module comprises an eleventh TFT having the gate connected to a general control signal, the source connected to the general control signal, and the drain connected to scanning signal output terminal.

The reset module comprises a thirteenth TFT having the gate connected to a reset signal, the source connected to the reset signal, and the drain connected to a second junction.

The GOA unit at the nth stage further comprises a first capacitor having its two terminals connected to a first junction and a low-level signal, respectively.

The GOA unit at the nth stage further comprises a second capacitor having its two terminals connected to a second junction and a low-level signal, respectively.

As described, the GOA circuit of the present invention excludes the line of afterimage from the active area, thereby allowing the fast black frame insertion after abnormal shutdown.

BRIEF DESCRIPTION OF THE DRAWINGS

In order to more clearly illustrate the embodiments of the present invention or prior art, the following figures will be described in the embodiments are briefly introduced. It is obvious that the drawings are merely some embodiments of the present invention, those of ordinary skill in this field can obtain other figures according to these figures without paying the premise.

DETAILED DESCRIPTION OF PREFERRED EMBODIMENTS

Figure 2:
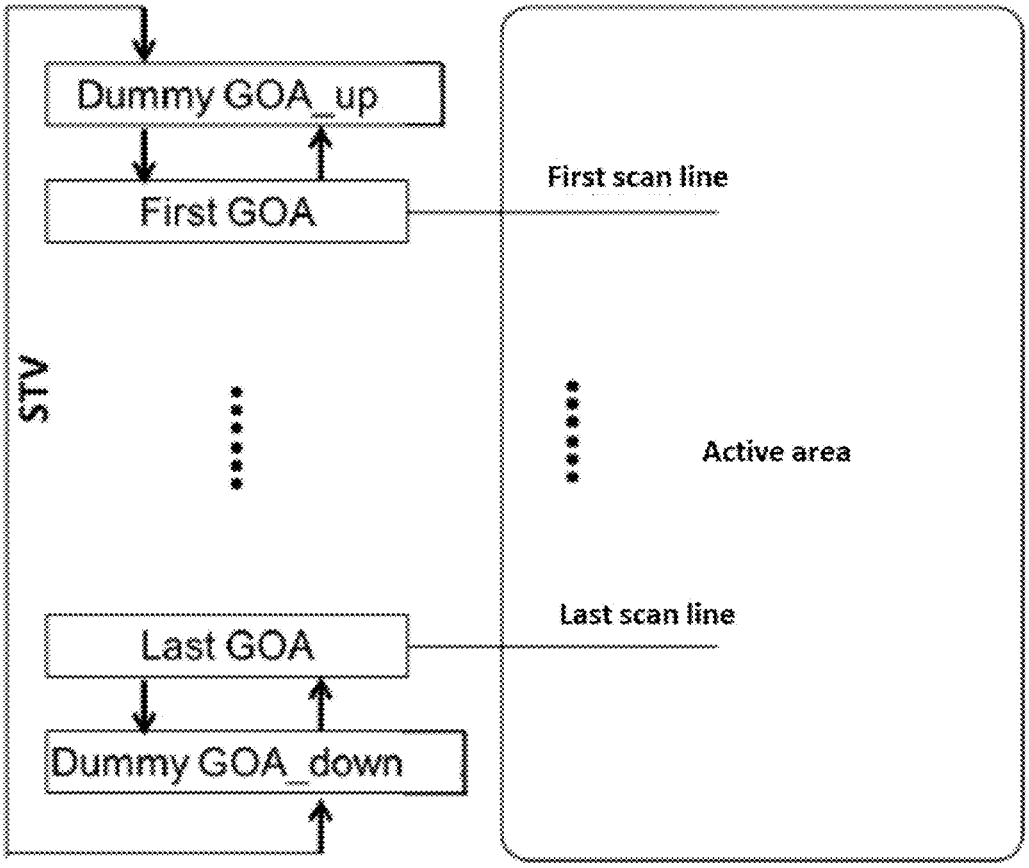
FIG. 2 is a schematic diagram showing a GOA circuit according to an embodiment of the present invention.

FIG. 2 is a schematic diagram showing a GOA circuit according to an embodiment of the present invention. As illustrated, the present embodiment includes a number of cascaded GOA units. These GOA units include two dummy GOA units and a number of normal GOA units. The dummy GOA units, namely Dummy GOA_up unit and Dummy GOA_down units, are not connected to the gate lines of the active area (AA). The normal GOA units, namely First GOA unit, . . . ; Last GOA unit, are cascaded into a chain and are respectively connected to the gate lines of the active area, namely First gate line, . . . ; Last gate line. The Dummy GOA_up unit is cascaded to the First GOA unit of the chain, and the Dummy GOA_down unit is cascaded to the Last GOA unit of the chain. The start signal STV for vertical scanning is fed to the Dummy GOA_up unit and the Dummy GOA_down unit.

The present invention is not limited to the structure illustrated in FIG. 2. For a forward scanning structure, a single dummy GOA unit may be provided, which is the Dummy GOA_up unit; for a backward scanning structure, also a single GOA unit may be provided, which is Dummy GOA_down unit.

The present invention, by cascading the dummy GOA units such as the Dummy GOA_up unit and the Dummy GOA_down unit to the chain of normal GOA units as shown in FIG. 2, and by disconnecting the dummy GOA units from the active area, achieves the removal of afterimage after abnormal shutdown. The present invention feeds the start signal STV for vertical scanning into the dummy GOA units for them to control the afterimage.

Figure 1:
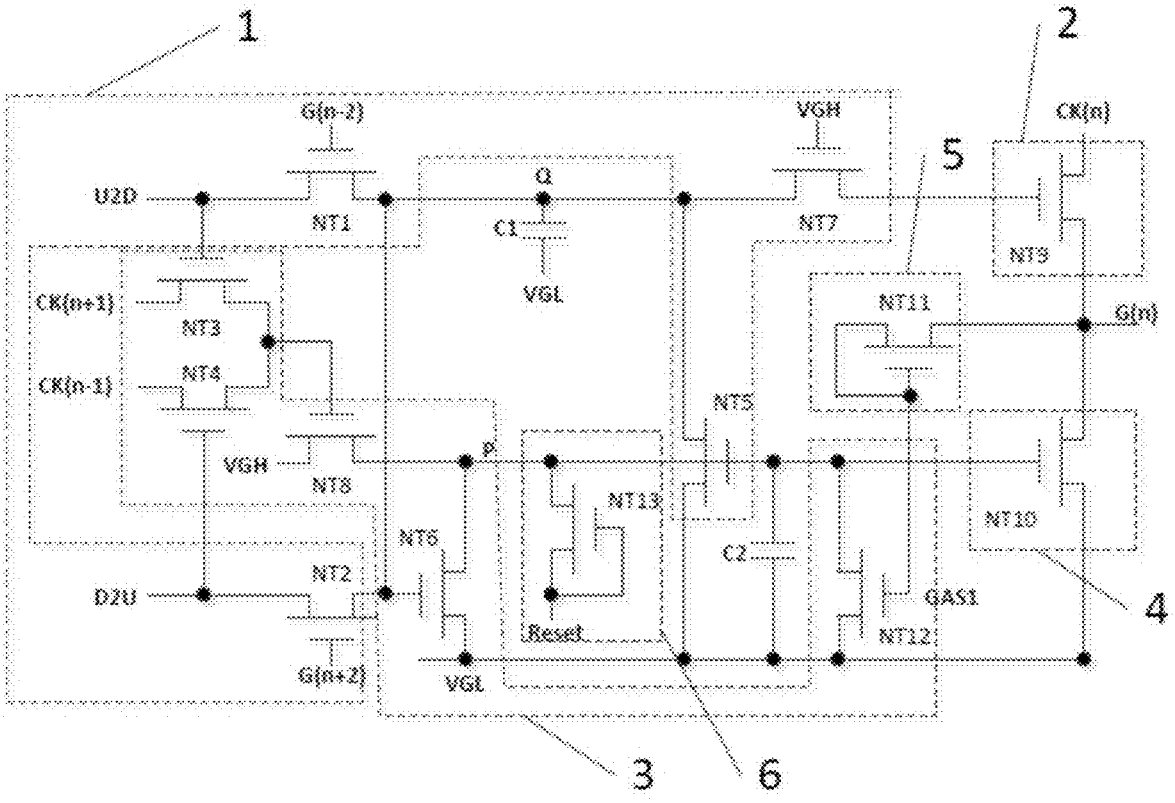
FIG. 1 is a circuit diagram showing a GOA circuit according to an embodiment of present invention.

FIG. 1 is a circuit diagram showing a GOA circuit according to an embodiment of present invention. What is shown in FIG. 1 is exemplary and the present invention does not exclude other possible structure. The dummy GOA units including Dummy GOA_up unit and Dummy GOA_down unit and normal GOA units including First GOA unit, . . . ; Last GOA unit may be implemented using the circuit structure shown in FIG. 1.

As shown in FIG. 1, a GOA unit at an nth stage mainly includes a pull-up control module 1, a pull-up module 2, a pull-down control module 3, a pull-down module 4, a general control module 4, and a reset module 6. The pull-up control module 1 receives cascaded signal from a GOA unit at a previous stage or at a next stage, and controls the pull-up module 2 to pull up the voltage level at the GOA unit's scanning signal output terminal G(n). The pull-down control module 3 controls the pull-down module 4 to pull down the voltage level at the GOA unit's scanning signal output terminal G(n). The general control module 5 controls the voltage level at the GOA unit's scanning signal output terminal G(n). The reset module 6 resets the voltage level at the GOA unit's scanning signal output terminal G(n).

In the present embodiment, the pull-up control module 1 mainly includes thin film transistors (TFTs) NT1, NT2, NT5, and NT7. The pull-up module 2 mainly includes NT9. The pull-up control module 1 receives the cascaded signal from the GOA unit at the G(n−2) and/or G(n+2) stage, and controls the pull-up module 2 to raise the voltage level at the scanning signal output terminal G(n). The pull-down control module 3 mainly includes NT3, NT4, NT6, NT8, and NT12. The pull-down module 4 mainly includes NT10. The pull-down control module 3 controls the pull-down module 4 to lower the voltage level at the scanning signal output terminal G(n). The general control module 5 mainly includes NT11, and controls the voltage level at the scanning signal output terminal G(n). The reset module 6 mainly includes NT13, and resets the voltage level at the scanning signal output terminal. The GOA circuit also includes capacitors C1 and C2 for maintaining voltage level.

The present embodiment conducts forward/backward scanning, and the pull-up control module 1 is required to receive cascaded signal from both the GOA units of a previous stage and a next stage. When conducting forward scanning, the First GOA unit has the Dummy GOA_up unit as the one at the previous stage, and the cascaded signal is the start signal STV. As to a GOA unit at the nth stage, it has the GOA unit at the (n−2)th stage as the one at the previous stage, and the cascaded signal is from the scanning signal output terminal G(n−2). When conducting backward scanning, the Last GOA unit has the Dummy GOA_down unit as the one at the previous stage, and the cascaded signal is the start signal STV. As to a GOA unit at the nth stage, it has the GOA unit at the (n+2)th stage as the one at the previous stage, and the cascaded signal is from the scanning signal output terminal G(n+2).

According to specific requirement on structure, driving method, and scanning direction, the GOA circuit may also perform scanning line-by-line, alternately, forward, and/or backward, etc. The cascaded signal may also be other type of signal of different format.

Figure 3:
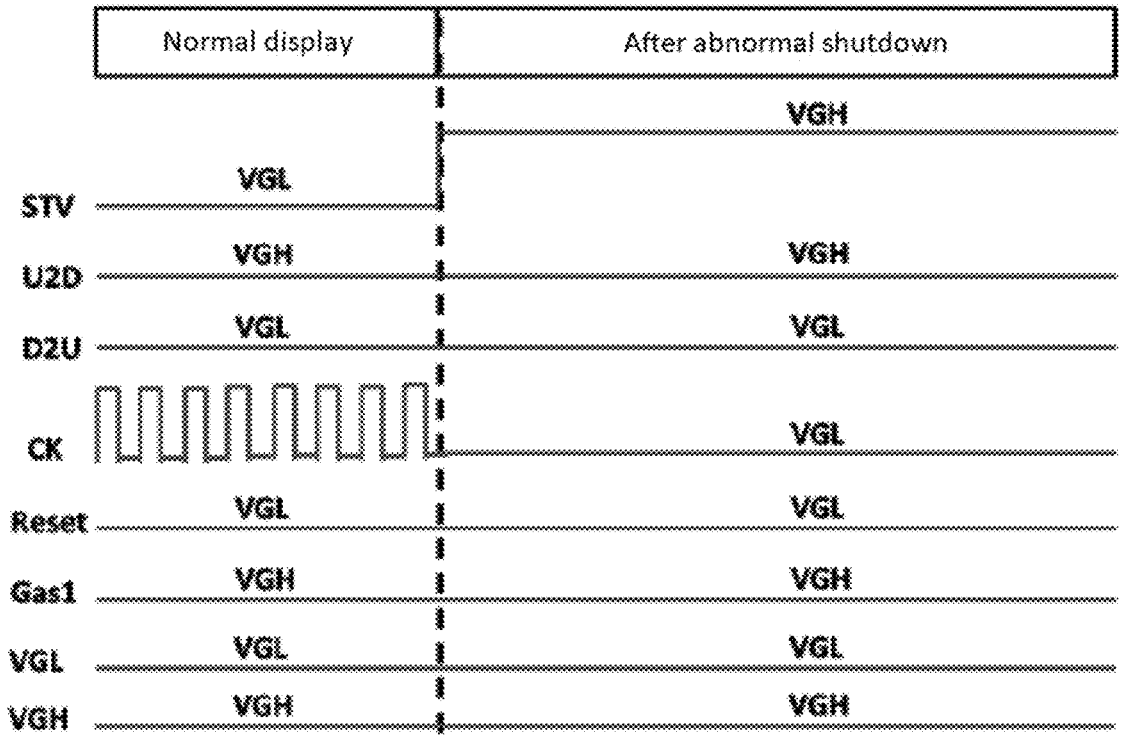
FIG. 3 is a timing diagram showing various signals of a GOA circuit according to an embodiment of the present invention in achieving fast black frame insertion.

FIG. 3 is a timing diagram showing various signals of a GOA circuit according to an embodiment of the present invention in achieving fast black frame insertion after abnormal shutdown. As illustrated, after abnormal shutdown, the start signal STV is changed from the low-level signal VGL to the high-level signal VGH, and the clock signal CK becomes the low-level signal VGL.

The fast black frame insertion process after abnormal shutdown is explained as follows, together with FIGS. 1 to 3. For the Dummy GOA_up unit embodied in FIG. 1, the start signal STV is connected to G(n−2) terminal of FIG. 1, the First GOA unit is connected to the G(n+2) terminal of FIG. 1. After abnormal shutdown, the start signal STV and a forward scanning signal U2D are the high-level signal VGH, causing the Dummy GOA_up unit's junction Q has the high-level signal VGH. NT9 is therefore turned on, conducting clock signal CK's low-level signal VGL to the scanning signal output terminal G(n). In the meantime, a general control signal GAS1 is the high-level signal VGH, thereby turning on NT12 and NT11. Turning on NT12 delivers the low-level signal VGL to the gate of NT10, thereby shutting NT10 down. Turning on NT11 delivers the high-level signal VGH to the scanning signal output terminal G(n). Therefore, for the Dummy GOA_up unit, NT11 and NT9 are both turned on. The scanning signal output terminal G(n) has a voltage divided from short circuiting the clock signal CK and the general control signal GAS1, which is about 0V.

For the First GOA_up unit embodied in FIG. 1, the scanning signal output terminal G(n) of the Dummy GOA_up is connected to G(n−2) terminal of FIG. 1, the GOA unit at the next stage is connected to the G(n+2) terminal of FIG. 1. As described above, after abnormal shutdown, the Dummy GOA_up unit has around 0V at its scanning signal output terminal G(n). The forward scanning signal U2D is the high-level signal VGH, causing the First GOA_up unit's junction Q has voltage level around 0V. NT9 is slightly turned on, conducting a small portion of the clock signal CK's low-level signal VGL to the scanning signal output terminal G(n). In the meantime, the general control signal GAS1 is the high-level signal VGH, thereby turning on NT12 and NT11. Turning on NT12 shuts down NT10. Turning on NT11 delivers the high-level signal VGH to the scanning signal output terminal G(n). Therefore, for the First GOA_up unit, NT11 is turned on and NT9 is slightly turned on. The scanning signal output terminal G(n) has a voltage divided from short circuiting a small portion of the clock signal CK and the general control signal GAS1, which is a positive voltage close to VGH.

For the GOA units other than the First and Dummy GOA_up units, their G(n−2) terminals are all connected to the scanning signal output terminal G(n) of the GOA unit at the previous stage. Their operation is identical to that of the First GOA unit. Therefore, their scanning signal output terminal G(n) is a positive voltage close to VGH.

For the GOA units other than the Dummy GOA_up unit, their scanning signal output terminal G(n) all have a positive voltage close to VGH. The scan lines in the active area connected to these GOA units' scanning signal output terminals G(n) are all turned on, allowing the fast black frame insertion. At this point, only the scanning signal output terminal G(n) of the Dummy GOA_up unit is about 0V. The Dummy GOA_up unit therefore does not support fast black frame insertion and there is a risk of afterimage. But the Dummy GOA_up unit is not connected to the active area, so the fast black frame insertion is not affected.

As described, the GOA circuit of the present invention uses the start signal STV to confine the line of afterimage to the line where the start signal STV is connected. Then, by the connecting the start signal STV to the dummy GOA unit, and disconnecting the dummy GOA unit from the active area, the line of afterimage is excluded from the active area, thereby allowing the fast black frame insertion after abnormal shutdown.

Above are embodiments of the present invention, which does not limit the scope of the present invention. Any equivalent amendments within the spirit and principles of the embodiment described above should be covered by the protected scope of the invention.

What is claimed is:

1. A Gate Driver on Array (GOA) circuit for a display panel comprising a plurality of cascaded GOA units, wherein the GOA units comprises a first dummy GOA unit and/or a second dummy GOA unit not connecting scan lines of the display panel's active area;

the GOA units further comprises a plurality of normal GOA units connecting scan lines of the active area;

the normal GOA units are cascaded into a chain of normal GOA units;

the first dummy GOA unit is cascaded to a first normal GOA unit of the chain of normal GOA units and/or the second dummy GOA unit is cascaded to a last normal GOA unit of the chain of normal GOA units;

a start signal of the display panel's vertical scanning as a cascaded signal is input into the first dummy GOA unit and/or the start signal as a cascaded signal is input into the second dummy GOA unit;

a GOA unit at a nth (n is a natural number) stage of the plurality of cascaded GOA units comprises a pull-up control module, a pull-up module, a pull-down control module, a pull-down module, a general control module, and a reset module;

the pull-up control module receives the cascaded signal from a GOA unit at a previous stage and/or at a next stage, and controls the pull-up module to pull up a voltage level at the GOA unit's scanning signal output terminal;

the pull-down control module controls the pull-down module to pull down the voltage level at the GOA unit's scanning signal output terminal;

the general control module controls the voltage level at the GOA unit's scanning signal output terminal;

the reset module resets the voltage level at the GOA unit's scanning signal output terminal; and the pull-down control module comprises:

a third TFT having the gate connected to a forward scanning signal, the source connected to a (n+1)th-stage clock signal, and the drain connected to the gate of an eighth TFT;

a fourth TFT having the gate connected to a backward scanning signal, the source connected to a (n−1)th-stage clock signal, and the drain connected to the gate of the eighth TFT;

a sixth TFT having the gate connected to a first junction, the source connected to a second junction, and the drain connected to a low-level signal;

the eighth TFT having the source connected to the second junction, and the drain connected to a high-level signal; and a twelfth TFT having the gate connected to a general control signal, the source connected to the second junction, and the drain connected to the low-level signal.

2. The GOA circuit according to claim 1, wherein the pull-up control module comprises a first thin film transistor (TFT) having the gate connected to the scanning signal output terminal of a GOA unit at a (n−2)th stage, the source connected to a forward scanning signal, and the drain connected to a first junction;

a second TFT having the gate connected to the scanning signal output terminal of a GOA unit at a (n+2)th stage, the source connected to a backward scanning signal, and the drain connected to the first junction;

a fifth TFT having the gate connected to a second junction, the source connected to the first junction, and the drain connected to a low-level signal; and a seventh TFT having the gate connected to a high-level signal, the source connected to the first junction, and the drain, as the pull-up control module's output terminal, connected to the pull-up module.

3. The GOA circuit according to claim 1, wherein the pull-up module comprises a ninth TFT having the gate connected to an output terminal of the pull-up control module, the source connected to a nth-stage clock signal, and the drain connected to the scanning signal output terminal.

4. The GOA circuit according to claim 1, wherein the pull-down module comprises a tenth TFT having the gate connected to a second junction, the source connected to the scanning signal output terminal, and the drain connected to a low-level signal.

5. The GOA circuit according to claim 1, wherein the general control module comprises an eleventh TFT having the gate connected to a general control signal, the source connected to the general control signal, and the drain connected to scanning signal output terminal.

6. The GOA circuit according to claim 1, wherein the reset module comprises a thirteenth TFT having the gate connected to a reset signal, the source connected to the reset signal, and the drain connected to a second junction.

7. The GOA circuit according to claim 1, wherein the GOA unit at the nth stage further comprises a first capacitor having its two terminals connected to a first junction and a low-level signal, respectively.

8. The GOA circuit according to claim 1, where the GOA unit at the nth stage further comprises a second capacitor having its two terminals connected to a second junction and a low-level signal, respectively.

* * * * *